US008851935B2

(12) United States Patent
Yoshioka et al.

(10) Patent No.: US 8,851,935 B2
(45) Date of Patent: Oct. 7, 2014

(54) ELECTRICAL WIRE HARNESS CONNECTOR

(75) Inventors: Nobuaki Yoshioka, Makinohara (JP); Yasuhiro Yamaguchi, Makinohara (JP); Ikuo Morita, Makinohara (JP)

(73) Assignee: Yazaki Corporation, Tokyo (JP)

( * ) Notice: Subject to any disclaimer, the term of this patent is extended or adjusted under 35 U.S.C. 154(b) by 77 days.

(21) Appl. No.: 13/395,908

(22) PCT Filed: Jan. 24, 2011

(86) PCT No.: PCT/JP2011/051216

§ 371 (c)(1),
(2), (4) Date: Mar. 14, 2012

(87) PCT Pub. No.: WO2011/093242

PCT Pub. Date: Aug. 4, 2011

(65) Prior Publication Data

US 2012/0178300 A1 Jul. 12, 2012

(30) Foreign Application Priority Data

Jan. 27, 2010 (JP) ..... 2010-015208

(51) Int. Cl.

| | |
|---|---|
| ***H01R 13/04*** | (2006.01) |
| ***H01R 13/405*** | (2006.01) |
| ***H01R 4/02*** | (2006.01) |
| *H01R 24/28* | (2011.01) |
| *H01R 105/00* | (2006.01) |

(52) U.S. Cl.

CPC ..... *H01R 13/405* (2013.01); *H01R 4/023* (2013.01); *H01R 24/28* (2013.01); *H01R 2105/00* (2013.01)

USPC ..... 439/694; 439/604

(58) Field of Classification Search

USPC ..... 439/499, 694, 604, 881, 626

See application file for complete search history.

(56) References Cited

U.S. PATENT DOCUMENTS 3,090,936 A * 5/1963 Maitby ..... 439/595
3,218,604 A * 11/1965 Reimer ..... 439/606

(Continued)

FOREIGN PATENT DOCUMENTS

CN 101454943 A 6/2009
JP 64-4072 U 1/1989

(Continued)

OTHER PUBLICATIONS

International Search Report (PCT/ISA/210) issued by the International Searching Authority in corresponding International Application No. PCT/JP2011/051216 on Feb. 15, 2011.

(Continued)

*Primary Examiner* — Neil Abrams
(74) *Attorney, Agent, or Firm* — Sughrue Mion, PLLC

(57) ABSTRACT

A connector includes a plurality of terminal metal fittings that are arranged in parallel to one another and respectively have electric wire connection sections to which electric wires are electrically connected, and a connector housing that accommodates the plurality of terminal metal fittings therein. The plurality of terminal metal fittings are configured that the lengths of the electric wire connection sections are made longer in accordance with the arrangement thereof from one side toward the other side in an arrangement direction of the plurality of terminal metal fittings. The electric wires are connected to the electric wire connection sections respectively so that the electric wires extend from one end portions of the electric wire connection sections toward the one side and intersect with a longitudinal direction of the electric wire connection section.

3 Claims, 3 Drawing Sheets

(56) References Cited

U.S. PATENT DOCUMENTS

| | | | | |
|---|---|---|---|---|
| 5,447,454 | A | 9/1995 | Inaba et al. | |
| 6,815,610 | B2 * | 11/2004 | Kuboshima et al. | 174/360 |
| 7,059,918 | B2 * | 6/2006 | Matsumoto et al. | 439/752 |
| 7,077,676 | B2 * | 7/2006 | Matsumoto et al. | 439/271 |
| 7,094,098 | B2 * | 8/2006 | Miyazaki | 439/559 |
| 7,097,498 | B2 * | 8/2006 | Miyazaki | 439/559 |
| 7,165,995 | B2 * | 1/2007 | Fukushima et al. | 439/607.58 |
| 7,268,300 | B2 * | 9/2007 | Miyazaki | 174/138 F |
| 7,597,580 | B1 * | 10/2009 | Advey et al. | 439/383 |
| 7,637,761 | B1 * | 12/2009 | Arnold | 439/212 |
| 7,645,157 | B2 * | 1/2010 | Mizutani et al. | 439/382 |
| 8,167,653 | B2 * | 5/2012 | Hasegawa et al. | 439/607.41 |
| 8,187,030 | B2 * | 5/2012 | Matsuoka et al. | 439/542 |
| 8,257,096 | B2 * | 9/2012 | Matsuoka et al. | 439/76.2 |
| 8,556,660 | B2 * | 10/2013 | Matsuoka et al. | 439/626 |
| 8,602,823 | B2 * | 12/2013 | Jimbo | 439/607.5 |
| 8,672,706 | B2 * | 3/2014 | Matsumoto et al. | 439/489 |
| 8,764,481 | B2 * | 7/2014 | Matsumoto et al. | 439/595 |
| 8,790,135 | B2 * | 7/2014 | Maegawa | 439/587 |
| 2004/0057187 | A1 | 3/2004 | Kuboshima et al. | |
| 2004/0088857 | A1 | 5/2004 | Fujimoto et al. | |
| 2006/0121773 | A1 | 6/2006 | Ichikawa et al. | |
| 2009/0137153 | A1 | 5/2009 | Yoshioka et al. | |
| 2009/0277671 | A1 | 11/2009 | Hahn | |
| 2012/0178300 | A1 * | 7/2012 | Yoshioka et al. | 439/626 |
| 2012/0208404 | A1 * | 8/2012 | Matsumoto et al. | 439/661 |
| 2013/0017720 | A1 * | 1/2013 | Maegawa | 439/595 |
| 2013/0171853 | A1 * | 7/2013 | Tsujii et al. | 439/271 |
| 2014/0004740 | A1 * | 1/2014 | Uno et al. | 439/607.58 |

FOREIGN PATENT DOCUMENTS

| | | | |
|---|---|---|---|
| JP | 2-32676 | U | 2/1990 |
| JP | 06-302357 | A | 10/1994 |
| JP | 200495293 | A | 3/2004 |
| JP | 2004-119047 | A | 4/2004 |
| JP | 2005319497 | A | 11/2005 |
| JP | 2006-120364 | A | 5/2006 |
| JP | 2006156052 | A | 6/2006 |
| JP | 2009-129811 | A | 6/2009 |

OTHER PUBLICATIONS

Office Action, dated Oct. 29, 2013, issued by the Japanese Patent Office in counterpart Japanese Patent Application No. 2010-015208.

Office Action dated Jan. 3, 2014, issued by the State Intellectual Property Office of the People's Republic of China in counterpart Chinese Application No. 201180004034.2.

Japanese Office Action, Application No. 2010015208; May 21, 2014.

Communication dated Jul. 10, 2014 issued by the State Intellectual Property Office of the People's Republic of China in Counterpart Chinese Patent Application No. 201180004034.2.

* cited by examiner

ELECTRICAL WIRE HARNESS CONNECTOR

TECHNICAL FIELD

The present invention relates to a connector used for connection or the like of electric wires.

BACKGROUND ART

A large variety of electronic devices are mounted on a vehicle as a movable body. For this reason, wire harnesses are arranged so as to transmit electric power or control signals to the electronic devices in the vehicle. Such a wire harness has a plurality of electric wires and a connector. Each of the electric wires is a so-called covered electric wire having a conductive core wire and an insulative sheath portion covering the core wire. The electronic device and the wire harness are connected to each other in such a manner that the connectors respectively provided thereon are engaged with each other.

As the connector, for example, a connector having a plurality of terminal metal fittings connected to end portions of the respective plurality of electric wires and a connector housing accommodating the plurality of terminal metal fittings, is used (see, for example, Patent Document 1). Each of the terminal metal fittings is made of a conductive metal plate and is electrically connected to the core wire of the electric wire. The plurality of terminal metal fittings are arranged in parallel to one another at an interval in the connector housing.

The connector housing is made of an insulative synthetic resin, and includes a tubular terminal accommodation section accommodating the plurality of terminal metal fittings at its inside and a cover which is integrally formed with the terminal accommodation section and accommodates the electric wires at its inside. The cover accommodates the plurality of electric wires drawn from the terminal accommodation section in a state that the plurality of electric wires are bent in a direction perpendicular to a longitudinal direction of the plurality of terminal metal fittings in the terminal accommodation section.

In the connector having the above configuration, the plurality of electric wires drawn from the terminal accommodation section of the connector housing are accommodated in the cover in a state that the electric wires are bent in the direction perpendicular to the longitudinal direction of the plurality of terminal metal fittings in the terminal accommodation section. Accordingly, the plurality of electric wires can be bent and drawn from the connector housing at a rear end side.

PRIOR ART DOCUMENTS

Patent Documents

Patent Document 1: JP-A-2006-120364

SUMMARY OF INVENTION

Problems to be Solved by the Invention

However, in the connector disclosed by Patent document 1, since the plurality of electric wires are bent and drawn from the connector housing at the rear end side, a load may be applied to the electric wires so that defective conduction may be caused thereby. In addition, since the cover for bending the wires is provided on the connector housing, a problem arises that the connector is enlarged.

In view of the above problems, the purpose of the invention is to provide a connector capable of reducing a load applied to an electric wire and being miniaturized.

Means for Solving the Problems

A connector according to a first aspect of the invention includes a plurality of terminal metal fittings that are arranged in parallel to one another and respectively have electric wire connection sections to which electric wires are electrically connected; and a connector housing that accommodates the plurality of terminal metal fittings therein, the plurality of terminal metal fittings are configured that the lengths of the electric wire connection sections are made longer in accordance with the arrangement thereof from one side toward the other side in an arrangement direction of the plurality of terminal metal fittings, and the electric wires are connected to the electric wire connection sections respectively so that the electric wires extend from one end portions of the electric wire connection sections toward the one side and intersect with a longitudinal direction of the electric wire connection section.

In the connector according to a second aspect of the invention based on the first aspect of the invention, the electric wire connection sections and the electric wires are respectively superposed on each other and are welded to each other.

In the connector according to a third aspect of the invention based on the second aspect of the invention, the connector housing is integrally formed with the electric wire connection sections and end portions of the electric wires by mold-forming a synthetic resin having an insulative property around the plurality of terminal metal fittings and the end portions of the electric wires.

The connector according to a fourth aspect of the invention based on the third aspect of the invention, includes a seal member covers a boundary portion between the connector housing and the electric wires and holds watertightness between an inner face of the connector housing and an outer face of each of the electric wires.

In accordance with the first aspect of the invention, the plurality of terminal metal fittings are so constituted that the length of the electric wire connection section is made longer in accordance with the arrangement thereof from one side toward the other side in the arrangement direction of the plurality of terminal metal fittings. The electric wires are connected to the respective electric wire connection sections in such a manner that each electric wire extends from the end portion of the electric wire connection section toward the one side in the arrangement direction of the plurality of terminal metal fittings and intersects with the longitudinal direction of the electric wire connection section. Therefore, the electric wires connected to the respective electric wire connection sections of the plurality of terminal metal fittings can be drawn to the outside of the connector housing along the arrangement direction of the plurality of terminal metal fittings without bending the electric wires.

In accordance with the second aspect of the invention, since the electric wire connection section and the electric wire are superposed on each other and are welded to each other, the connection between the electric wire connection section and the electric wire can be surely and readily carried out and a thickness of a connected portion between the electric wire connection section and the electric wire can be reduced.

In accordance with the third aspect of the invention, the connector housing is integrally formed with the electric wire connection sections and end portions of the electric wires in such a manner that the synthetic resin having the insulative property is applied around the plurality of terminal metal fittings and the end portions of the electric wires by mold-forming. Therefore, it is possible to make each of the connected portions between the electric wire connection sections of the plurality of terminal metal fittings and the respective electric wires to be not liable to be peeled from one another without increasing the number of components.

In accordance with the fourth aspect of the invention, the connector has a seal member which is provided so as to cover the boundary portion between the connector housing and the wires and holds watertightness between the inner face of the connector housing and the outer face of each of the electric wires. Therefore, it is possible to prevent, by virtue of the seal member, a liquid such as water or the like from entering into the connector housing through the electric wires.

Advantageous Effects of the Invention

As described above, in accordance with the first aspect of the invention, the electric wires connected to the respective electric wire connection sections of the plurality of terminal metal fittings can be drawn to the outside of the connector housing along the arrangement direction of the plurality of terminal metal fittings without bending the electric wires. Therefore, a load applied to the electric wires can be reduced and the height of the connector can be lowered. Consequently, it is possible to achieve the compact connector having a high reliability in connection.

In accordance with the second aspect of the invention, the connection between the electric wire connection section and the electric wire can be surely and readily carried out and the thickness of the connected portion between the electric wire connection section and the electric wire can be reduced. Consequently, it is possible to readily achieve the stable electric connection between the electric wire connection sections, i.e., the terminal metal fittings and the electric wires and to reduce the thickness of the connected portion between the electric wire connection section and the electric wire so as to miniaturize the connector.

In accordance with the third aspect of the invention, it is possible to make each of the connected portions between the electric wire connection sections of the plurality of terminal metal fittings and the respective electric wires to be not liable to be peeled from one another without increasing the number of components. Consequently, it is possible to achieve the compact connector having a high reliability in connection.

In accordance with the fourth aspect of the invention, since it is possible to prevent, by virtue of the seal member, a liquid such as water or the like from entering into the connector housing passing through the electric wires, it is possible to achieve waterproofing in the connector by a simple structure.

EMBODIMENT OF THE INVENTION

A connector according to an embodiment of the invention is described below with reference to accompanying FIGS. 1 to 6. The connector 1 according to the embodiment of the invention is attached to end portions of a plurality of electric wires 2 and is engaged with a mating connector (not shown), thereby forming a wire harness provided in a vehicle or the like.

Figure 1:
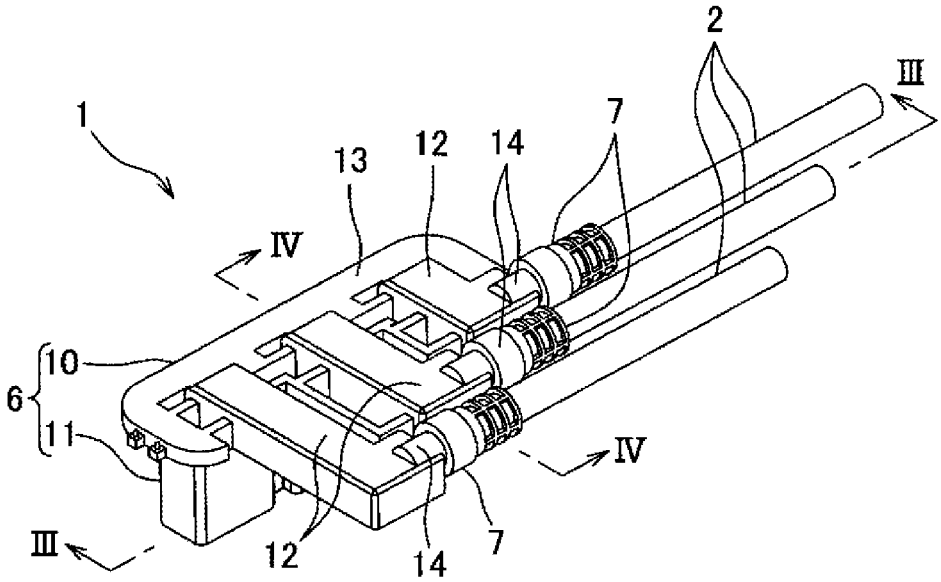
FIG. 1 is a perspective view showing a connector according to an embodiment of the invention.
Figure 2:
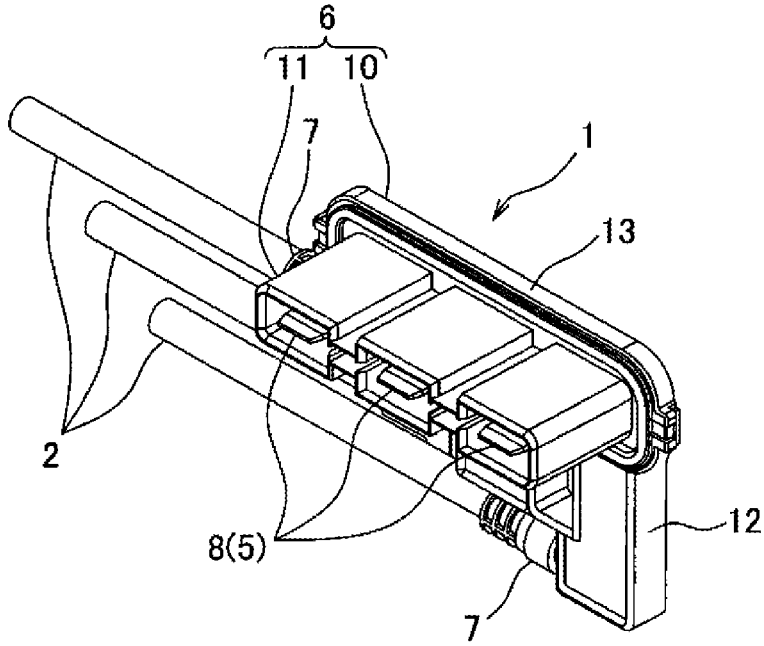
FIG. 2 is a perspective view showing the connector shown in FIG. 1 viewed from a lower side in FIG. 1.
Figure 3:
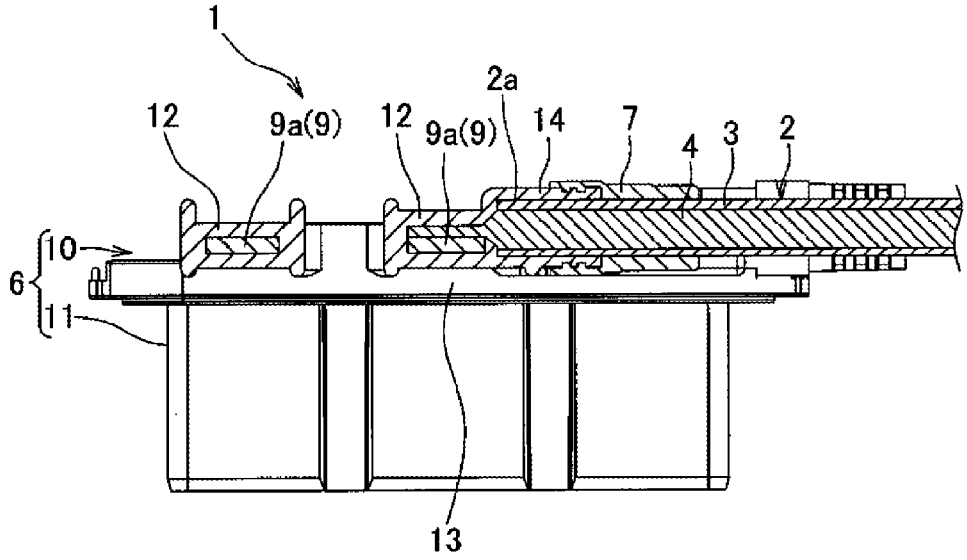
FIG. 3 is a cross sectional view from arrows taken along a line in FIG. 1.
Figure 4:
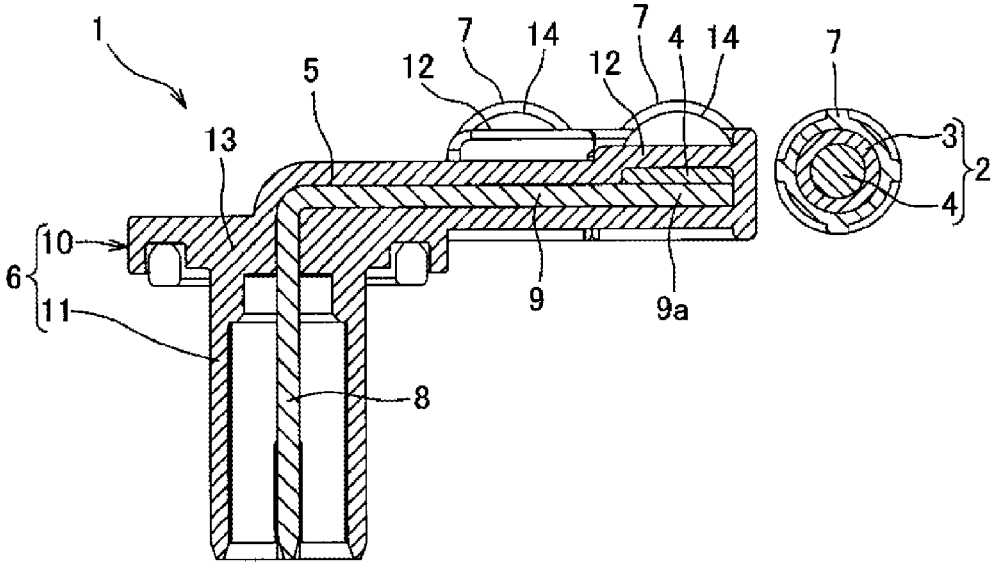
FIG. 4 is a cross sectional view from arrows taken along a line IV-IV in FIG. 1.
Figure 5:
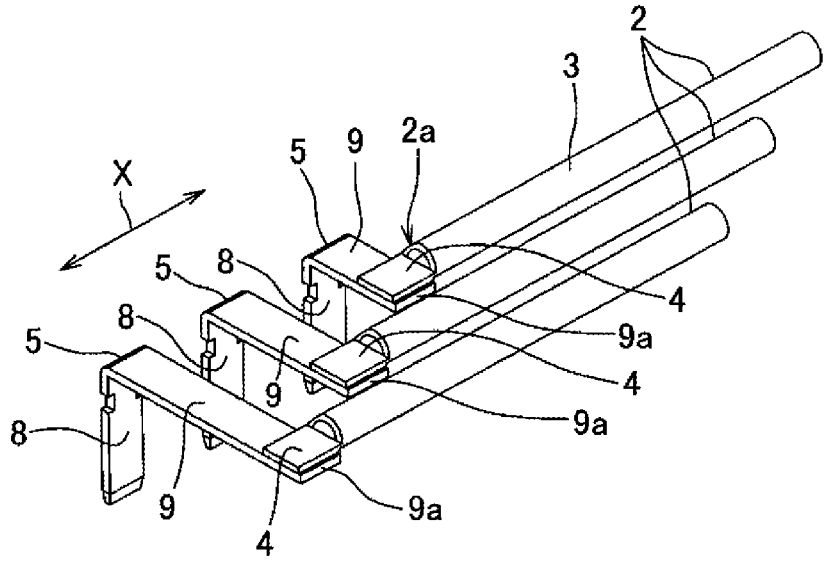
FIG. 5 is a perspective view showing a state that electric wires are respectively welded to a plurality of terminal metal fittings of the connector shown in FIG. 1.

The plurality of electric wires 2, i.e., three electric wires in the embodiment are arranged in parallel to one another as shown in FIGS. 1 and 2. Each of the plurality of electric wires 2 is formed to have a circular cross section and has a core wire 4 and a sheath portion 3 covering the core wire 4 as shown in FIGS. 3 to 5. The core wire 4 is made of metal having conductivity such as copper, copper alloy or the like, and is formed of a single conductive wire or a plurality of stranded conductive wires so as to have a circular cross section. The sheath portion 3 is made of a synthetic resin having an insulative property and covers the core wire 4 while holding an insulating condition of the core wire 4. In each of the plurality of electric wires 2, the sheath portion 3 is removed by a predetermined length so that the core wire 4 is exposed at each end portion 2*a*.

As shown in FIGS. 1 and 2, the connector 1 includes a plurality of terminal metal fittings 5, a connector housing 6 accommodating the plurality of terminal metal fittings 5 at its inside, and a seal member 7.

The plurality of terminal metal fittings 5, i.e., three terminal metal fittings in the embodiment, are arranged in parallel to one another as shown in FIG. 5. Each of the plurality of terminal metal fittings 5 is made of conductive metal or the like, is integrally provided with an electric contact section 8 and an electric wire connection section 9, and is formed in an L-shape viewed from the side. The electric contact section 8 is formed in a band plate shape and is electrically connected to a terminal metal fitting of a mating connector (not shown). The electric wire connection section 9 is formed in a band plate and is vertically provided at an end portion of the electric contact section 8 in a state that it is perpendicular to the electric contact section 8.

In addition, the plurality of terminal metal fittings 5 are so constituted that the length of the electric wire connection section 9 is made longer as the position thereof goes from one side (the right side in FIG. 5) toward the other side (the left side in FIG. 5) in a direction X, shown by arrow in FIG. 5, of arrangement of the plurality of terminal metal fittings 5.

Regarding the plurality of terminal metal fittings 5, each core wire 4 which is exposed by removing the sheath portion 3 at the end portion 2*a* of the each electric wire 2, is superposed on an end portion 9*a* of each electric wire connection section 9 at a side away from the electric contact section 8 in such a manner that a longitudinal direction of the electric wire connection section 9 intersects with a longitudinal direction of each of the electric wires 2. By applying ultrasonic vibration to the end portions 9*a* of the electric wire connection sections 9 and the core wires 4 from a well-known ultrasonic welding machine, each of the electric wire connection sections 9 and the corresponding core wire 4 are welded with each other, and then the end portion 2*a* of each of the electric wires 2 is electrically connected to each of the end portions 9*a* of the respective electric wire connection sections 9, and is attached thereto.

Thus, each of the electric wires 2 is respectively connected to each of the plurality of terminal metal fittings 5 in such a manner that each electric wire 2 extends from the end portion 9*a* of the electric wire connection section 9 toward one side (the right side in FIG. 5) in the direction X of arrangement of the plurality of terminal metal fittings 5 and intersects with the longitudinal direction of the electric wire connection section 9.

Figure 6:
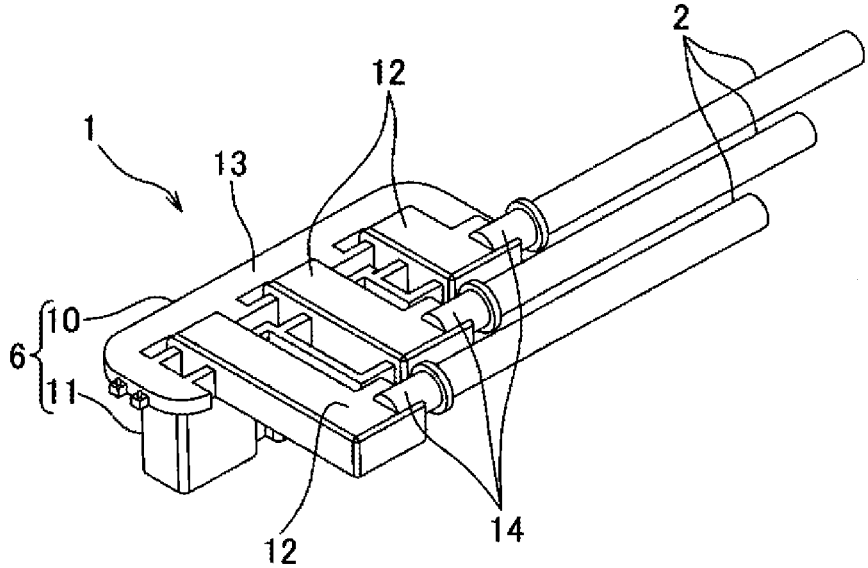
FIG. 6 is a perspective view showing a state that a connector housing is formed around the plurality of terminal metal fittings shown in FIG. 5 by mold-forming.

The connector housing 6 is integrally formed with the electric wire connection sections 9 of the plurality of terminal metal fittings 5 and end portions 2*a* of the respective electric wires 2 in such a manner that a synthetic resin having an insulative property is applied around the plurality of terminal metal fittings 5 and the end portions 2*a* of the respective electric wires 2 by mold-forming as shown in FIG. 5. As shown in FIG. 1 or 6, the connector housing 6 is integrally provided with a housing body 10 accommodating the electric wire connection sections 9 of the plurality of terminal metal fittings 5 and end portions 2*a* of the respective electric wires 2 in its inside, and an engagement tubular section 11 accommodating the electric contact sections 8 of the plurality of terminal metal fittings 5 in is inside, and the connector housing 6 is formed in an L-shape viewed from the side.

The housing body 10 has a plurality of terminal holding sections 12 arranged in parallel to one another at an interval, a coupling section 13 coupling the plurality of terminal holding sections 12 to one another and a plurality of electric wire holding sections 14. Each of the plurality of terminal holding sections 12 is formed in a rectangular column shape and is integrally formed with each electric wire connection section 9 in such a manner that each of the electric wire connection sections 9 of the plurality of terminal metal fittings 5 is buried in the corresponding terminal holding section 12.

The coupling section 13 is provided to be continuous to the plurality of terminal holding sections 12 at the end portions near the electric wire connection sections 9 so that the end portions of the plurality of terminal holding sections 12 are coupled to one another. The coupling section 13 is integrally formed with the end portions of the respective electric contact sections 8 in a state that the end portion of each of the electric contact sections 8 of the plurality of terminal metal fittings 5 penetrates the inside of the coupling section 13.

The plurality of electric wire holding sections 14 are continuously provided on respective end portions where the end portions 9*a* of the electric wire connection sections 9 of the terminal holding sections 12 are respectively positioned. Each of the plurality of electric wire holding sections 14 is formed in a round column shape and is integrally formed with each of the end portions 2*a* of the respective electric wires 2 in a state that the terminal 2*a* of each of the electric wires 2 penetrates the inside of the electric wire holding section 14.

As shown in FIGS. 2 to 4, the engagement tubular section 11 is provided so as to protrude from the coupling section 13 and extends in a direction perpendicular to the longitudinal direction of the plurality of terminal holding sections 12. The engagement tubular section 11 is formed in a rectangular tubular shape having a plurality of circumferential walls and is adapted to accommodate the electric contact sections 8 of the plurality of terminal metal fittings 5 at its inside. The engagement tubular section 11 is to be engaged with a connector housing of a mating connector (not shown).

The seal members 7, i.e., three seal members 7 in the embodiment, are provided corresponding to the electric wires 2 respectively connected to the plurality of terminal metal fittings 5 as shown in FIG. 1. Each of the plurality of seal member 7 is made of an elastic material such as a rubber or the like, and is integrally formed with each electric wire holding section 14 and each electric wire 2 by well known mold-forming or the like in a state that each electric wire holding section 14 of the connector housing 6 and each electric wire 2 penetrate the inside thereof as shown in FIG. 3 or 4. Each of the seal members 7 is formed in a tubular shape along the outer peripheries of each electric wire holding section 14 and each electric wire 2 so as to cover a boundary portion between each electric wire holding section 14 of the connector housing 6 and each electric wire 2.

Each of the plurality of seal members 7 having the structure holds watertightness between the inner face of each electric wire holding section 14, i.e., the connector housing 6 and the outer face of each electric wire 2.

In accordance with the embodiment, the plurality of terminal metal fittings 5 are so constituted that the length of the electric wire connection section 9 is made longer as the position thereof goes from one side toward the other side in the direction X of arrangement of the plurality of terminal metal fittings 5. The electric wires 2 are connected to the respective electric wire connection sections 9 in such a manner that each electric wire 2 extends from the end portion 9*a* of the electric wire connection section 9 toward one side in the direction X of arrangement of the plurality of terminal metal fittings 5 and intersects with the longitudinal direction of the electric wire connection section 9.

For this reason, the electric wire 2 connected to the respective electric wire connection section 9 of the plurality of terminal metal fittings 5 can be drawn to the outside of the connector housing 6 along the direction of arrangement of the plurality of terminal metal fittings 5 without bending the electric wires 2. Therefore, a load applied to the electric wire 2 can be reduced and the height of the connector 1 can be lowered. Consequently, it is possible to achieve the compact connector 1 having a high reliability in connection.

In addition, since the electric wire connection section 9 and the electric wire 2 are superposed on each other and are welded to each other, the connection between the electric wire connection sections 9 and the respective electric wires 2 can be surely and readily carried out and the thickness of the connected portion between the electric wire connection section 9 and the electric wire 2 can be reduced. Consequently, it is possible to readily achieve the stable electric connection between the electric wire connection sections, i.e., the terminal metal fittings 5 and the electric wires 2 and to reduce the thickness of the connected portion between the electric wire connection section 9 and the electric wire 2 so as to miniaturize the connector 1.

Further, the connector housing 6 is integrally formed with the electric wire connection sections 9 and the end portions 2*a* of the electric wires 2 in such a manner that a synthetic resin having an insulative property is applied around the plurality of terminal metal fittings 5 and the end portions 2*a* of the electric wires 2 by mold-forming. Therefore, it is possible to make each of the connected portions between the electric wire connection sections 9 of the plurality of terminal metal fittings 5 and the respective electric wires 2 to be not liable to be peeled from one another without increasing the number of components. Consequently, it is possible to achieve the compact connector 1 having a high reliability in connection.

Furthermore, the connector 1 has the seal members 7 which are provided so as to cover the boundary portions between the connector housing 6 and the wires 2 and hold watertightness between the inner face of the connector housing 6 and the outer faces of the electric wires 2. Therefore, it is possible to prevent, by virtue of the seal members 7, a liquid such as water or the like from entering into the connector housing 6 through the electric wires 2. Consequently, it is possible to achieve the waterproofing in the connector 1 by a simple structure.

While, in the description of the embodiment, the representative embodiment of the invention is indicated, the invention is not limited thereto. That is, the invention can be modified in a range without departing from the essence of the invention.

While the invention is described in detail by referring to the specific embodiment, it is understood by those of ordinary skill in the art that various modifications and changes can be made without departing from the sprit and scope of the invention.

This application is based on Japanese Patent Application (JP-2010-015208) filed on Jan. 27, 2010, the contents of which are incorporated herein by reference.

DESCRIPTION OF REFERENCE NUMERALS AND SIGNS

1 connector
2 electric wire
2*a* end portion
5 terminal metal fitting
6 connector housing
7 seal member
9 electric wire connection section
8*a* end portion
X direction of arrangement of a plurality of terminal metal fittings

The invention claimed is:

1. A connector comprising:

a plurality of terminal metal fittings that are arranged in parallel to one another and respectively have electric wire connection sections to which electric wires are electrically connected; and a connector housing that accommodates the plurality of terminal metal fittings therein, wherein the plurality of terminal metal fittings are configured such that the lengths of the electric wire connection sections are made longer in accordance with the arrangement thereof from one side toward the other side in an arrangement direction of the plurality of terminal metal fittings;

wherein the electric wires are connected to the electric wire connection sections respectively so that the electric wires extend from one end portions of the electric wire connection sections toward the one side and intersect with a longitudinal direction of the electric wire connection section; and wherein the connector housing is integrally formed with the electric wire connection sections and end portions of the electric wires by mold-forming a synthetic resin having an insulative property around the plurality of terminal metal fittings and the end portions of the electric wires.

2. The connector according to claim 1, wherein the electric wire connection sections and the electric wires are respectively superposed on each other and are welded to each other.

3. The connector according to claim al, further comprising:

a seal member covers a boundary portion between the connector housing and the electric wires and holds watertightness between an inner face of the connector housing and an outer face of each of the electric wires.

* * * * *